US008136962B2

(12) United States Patent
Marlonia

(10) Patent No.: US 8,136,962 B2
(45) Date of Patent: Mar. 20, 2012

(54) REMOTE CONTROLLED HIDEAWAY HOLIDAY AND PARTY LIGHTING

(75) Inventor: Ivy Antrinette Marlonia, Corona, CA (US)

(73) Assignee: Ivy Antrinette Marlonia, Chandler, AZ (US)

( * ) Notice: Subject to any disclaimer, the term of this patent is extended or adjusted under 35 U.S.C. 154(b) by 264 days.

(21) Appl. No.: 11/618,599

(22) Filed: Nov. 3, 2008

(65) Prior Publication Data

US 2010/0110668 A1 May 6, 2010

(51) Int. Cl.
*F21S 4/00* (2006.01)
*F21V 21/36* (2006.01)
*E04F 19/00* (2006.01)

(52) U.S. Cl. ..... 362/249.07; 362/249.16; 362/403; 52/28

(58) Field of Classification Search ..... 362/249.07, 362/249.16, 145, 152, 285, 286, 289, 372, 362/233, 576, 403; 52/28
See application file for complete search history.

(56) References Cited

U.S. PATENT DOCUMENTS

| | | | | |
|---|---|---|---|---|
| 3,569,691 | A | 3/1971 | Tracy | |
| 3,692,993 | A | 9/1972 | Robinson | |
| 4,128,863 | A | 12/1978 | Premetz | |
| 5,003,442 | A * | 3/1991 | Gallo et al. | 362/225 |
| 5,311,414 | A | 5/1994 | Branham, Sr. | |
| 5,404,279 | A | 4/1995 | Wood | |
| 5,510,966 | A | 4/1996 | Konecny | |
| 5,661,953 | A * | 9/1997 | Jolley | 53/430 |
| 5,813,751 | A | 9/1998 | Shaffer | |
| 5,823,655 | A | 10/1998 | Brooks | |
| D419,530 | S | 1/2000 | Wang et al. | |
| 6,224,232 | B1 | 5/2001 | Rodriguez | |
| 6,474,840 | B2 * | 11/2002 | Padermos | 362/145 |
| 6,655,817 | B2 * | 12/2003 | Devlin et al. | 362/233 |
| 6,676,069 | B1 * | 1/2004 | Davis | 242/609.1 |
| 6,918,680 | B2 | 7/2005 | Seeberger | |
| 7,018,066 | B2 | 3/2006 | Kirven | |
| 7,591,566 | B2 * | 9/2009 | Galke et al. | 362/285 |
| 7,878,684 | B2 * | 2/2011 | Nauman | 362/249.1 |
| 2003/0235053 | A1 | 12/2003 | Jones | |
| 2007/0056697 | A1 | 3/2007 | Chen | |
| 2008/0285294 | A1 * | 11/2008 | Kim | 362/487 |
| 2009/0113774 | A1 * | 5/2009 | Kinzel et al. | 40/473 |

* cited by examiner

*Primary Examiner* — David Crowe

(57) ABSTRACT

Improvements in remote control hideaway holiday/party lights/messages lights with a casing that is permanently fixed to a home or business is disclosed. The lights are on a string and roll up or down below over eve, fascia or rain gutters. After the holiday or event simply pressing a remote control will retract the lighting into a concealed enclosure till the next party or holiday season comes around. The remote has a distinctive key code, which makes the lights operate for each owner. The concealed enclosure consist of door(s), depends on the number of lighting styles, power supply, drive motor, a string light(s) on a spool inside and controls. The lights come in many colors and types and may include shapes. Each enclosure can be self-contained with a solar charger, light sensor, or timer, and a battery that allows each unit to operate autonomously.

20 Claims, 5 Drawing Sheets

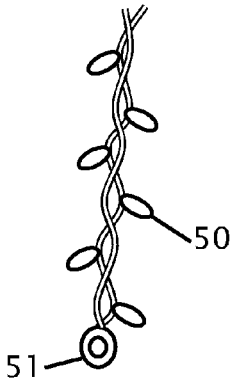
FIG. 2A
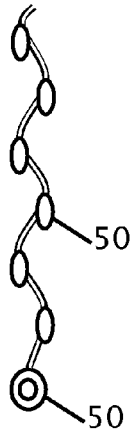
FIG. 2B
FIG. 2C
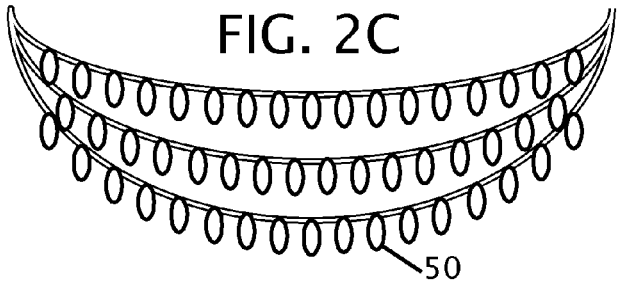
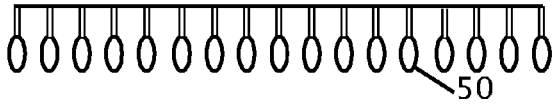
FIG. 2D
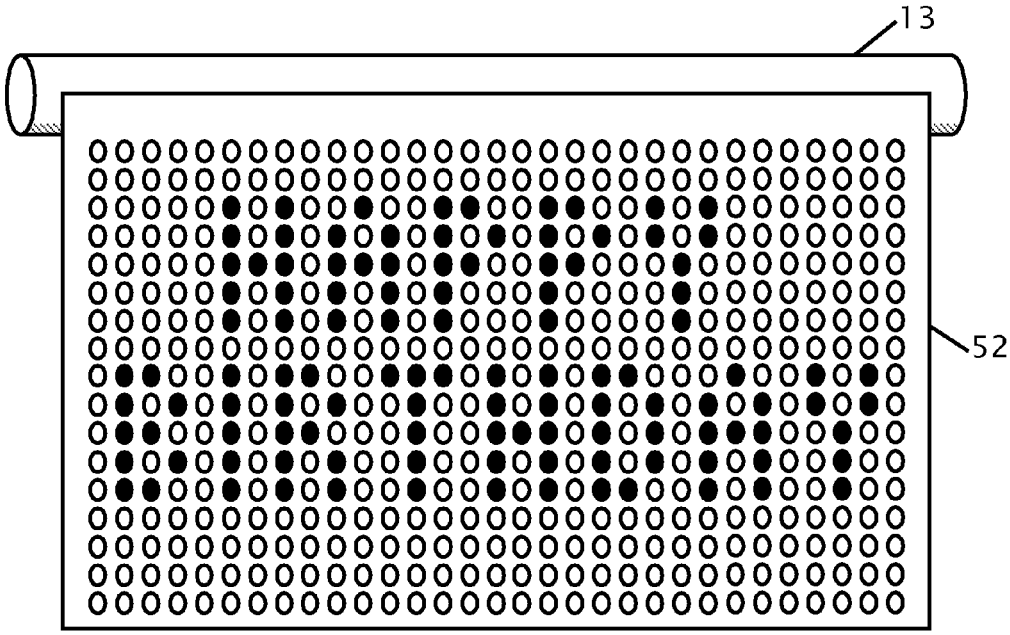
FIG. 3

REMOTE CONTROLLED HIDEAWAY HOLIDAY AND PARTY LIGHTING

CROSS REFERENCE TO RELATED APPLICATION

Not Applicable

STATEMENT REGARDING FEDERALLY SPONSERED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

This invention relates to improvements in lighting, more particularly the improvement relates to lighting that is used for holidays or parties where the lighting is concealable and rolls out of the concealing enclosure.

2. Description of Related Art including information disclosed under 37 CFR 1.97 and 1.98

Typically hanging of Christmas lights or holiday or party message required the use of a ladder and nailing the string of lights or holiday or party message to the overhang, borders, or rain gutters and after the holiday or event was complete climbing a ladder and removing the string lighting. Typically Christmas string lights where only use to actually celebrate Christmas now there's a growing use for lights whether to celebrate a graduation or wedding, anniversary now you can have programmable lights for any and all occasions. Several products and patents have been issued that try to simply displaying holiday or party light that are concealable. Exemplary examples of patents covering these products are disclosed herein.

U.S. Pat. No. 5,404,279 issued Apr. 4, 1995 to Johnny L. Wood and U.S. Pat. No. 6,224,232 issued May 1, 2001 to Greg Rodriguez disclose decorative or holiday lights with a cover that a homeowner manually flips open to display the concealed lighting. While these patents disclose holiday lighting that is concealable the homeowner is required to manually open the door to expose the lighting. In addition, if the lighting is located on a second floor the homeowner must climb on a ladder to open the door or cover.

U.S. Pat. No. 4,128,863 issued Dec. 5, 1978 to Michael J. Premetz, U.S. Pat. No. 5,510,966 issued Apr. 23, 1996, U.S. Pat. No. 6,918,680 issued Jul. 19, 2005 to James T. Seeberger and published application US2003/0235053 published Dec. 25, 2003 all disclose holiday lights on a hinge or pivot that a homeowner must rotate to move the lights from behind a housing eve or facia.. While these patents disclose holiday lighting that is concealable the homeowner is required to manually rotate the lights to expose the lighting. In addition, if the lighting is located on a second floor the homeowner must climb on a ladder to rotate the lights.

U.S. Pat. No. 3,569,691 issued Mar. 9, 1971 to Robert F. Tracy discloses an assembly for lights connected by a cable or wire to a manual crank. A spring at the opposing end of the cable or wire keeps tension on the cable or wire. As the crank is turned the lights are rotated out of the enclosure to expose them. While this patent discloses a manually extendable lighting system the apparatus does not work with rope lights and further must be custom manufactured for each house.

U.S. Pat. No. 5,003,442 issued Mar. 26, 1991 to Fred J. Gallo et al discloses a movable lighting apparatus. The movable lighting apparatus has a series of single lights that are pushed through an expandable telescope. A cable extends through the telescope arrangement of each light to retract the lights. While this patent discloses an expandable lighting system the lights are restricted to a candlestick type light and an external power supply to power the apparatus.

What is needed is a remotely controlled lighting system where the lighting system can be controlled by a time or remote control. The ideal systems would be expandable to fit different size eves or rafters.

BRIEF SUMMARY OF THE INVENTION

It is an object of the lighting system to use the lighting system for holidays or other occasions where the traditional hanging lights is performed the lighting system is extremely advantageous because it allows the home or business owner to control their lighting whether it's a holiday or personal celebration just with the touch of a button that allows the hideaway lights casing to open and the lighting will roll down the lights or holiday or party message (banner phrase) and with the same effort the lights or holiday or party message (banner phrase) will roll up on the tubing and casing doors will close.

It is an object of the lighting system to eliminate the need for consumer's to climb ladders and sustain serious injuries due to a fall. The lighting system is installed only once and is controlled safely from the ground for future events. Holiday lights or party lights are on a string and roll up or down below over hang, borders or rain gutters and after the holiday or the party is over simply press remote control up and away the lights roll back up into aluminum or steel tubing and aluminum or steel casing doors closed till the next party are holiday season comes around.

It is an object of the lighting system to eliminate the eyesore of seasonal lights that are usually taken down after the season. The remote control hideaway holiday/party lights & holiday messages w/ casing are permanent fixtures to home or business in which it's tucked underneath over hang, borders or rain gutters.

It is an object of the lighting system to operate with a remote control of the hideaway holiday/party lights to enter of change messages with casing and various light colors, patterns of holiday messages and symbols, and styles of lighting.

It is an object of the lighting system to provide the lights within an enclosure where the lights are rolled onto the aluminum tubing completely concealed inside the aluminum or steel casing that is a permanent fixture underneath the overhang, borders or rain gutters of a home or business. The casing itself, consist of doors, power supply to power lights, remote control adapter, rolling tubing up or down, operation of the casing doors is activated by remote control, toggle or timer switch or manually to open an roll down Christmas lights or Christmas message and close by remote control, toggle or timer switch or manually by rolling up Christmas lights or Christmas message.

It is another object of the lighting system for to use a remote control where a user can set a unique communications address with a distinctive key code comparable to a garage door setting which makes each owner display unique. The unique code allows the remote control holiday light display to be unaltered to the settings of a neighbor.

It is another object of the lighting system to be enclosed in a casing consist of door(s), where the number of doors depends on the number of lighting styles on a tubing inside the casing. There are several different types of lighting to choose from including but not limited to single, double and triple lighting styles, (up to 3 per casing). The power supply powers the string of lights remote control adapter, tubing rolling up or down, as well as operating the casing doors.

It is another object of the invention is a remote controlled celebratory lighting/message system that can be permanently affixed to a building or structure that gives the consumer choices to celebrate all their favorite holidays and special occasion i.e. New Years, Valentine's Day, St. Patrick's Day, Cinco De Mayo, Juneteenth, $4^{th}$ of July, Halloween, Thanksgiving, Christmas, Hanukkah, Kwanzaa, Cherry Blossom festival, happy anniversary, Weddings, Back Yard parties, etc. Now you can celebrate all your holidays and occasions in one celebratory illumination system at the push of a button, illuminating system is adjustable or expandable to fit between rafter or under the eaves (directly in the interior of the eaves) inside the new building or structure as well as allowing the lights to pulse or blink (dance) to the to the beat of the music, celebratory lights also ties into the home or business alarm system where the alarm systems activates the lights to roll up and down, repeatedly, celebratory lights have a motion sensor as people or cars or entities pass by the celebratory lights they appear to brighten or blink in the direction of movement, celebratory lighting system has various styles, patterns, colors of lights to represent all U.S. and International holidays and special events i.e. Valentines Day lights would be red, pink and white each holiday has it's own specific color representation. Now this removes the constant hassle of climbing up and down ladders yearly to hang, remove and store celebratory lighting and messages.

It is another object of the invention to have a casing unit when connections are seamless when installed (looks like one piece) rain gutters. where the lighting system can be controlled by a remote control. The ideal systems would be expandable to fit residential and commercial structures different dimension and sizes and is customizable to fit under the eaves or between the rafters.

It is another object of the invention for it to interface with the house alarm system of the structure.

It is another object of the invention for it to be installable or built on a gazebo built or on the exterior of the overhang of a structure.

It is still another object of the lighting system for the lights to come in many colors example (yellow, white, green, blue, red and orange). The type of lighting can be florescent, incandescent, LED.s etc. The shapes of the lights can be stars, flowers, and Christmas bulbs. Styles of Lighting (ex. string drape lighting identical to (2 or 3 strand pearls), string icicle lighting, string individual lighting (Christmas tree lighting), string balloon lighting using 3 or 4 balloons that are connected to the same line or strands on a string of lighting. The sizes of lighting can range from ⅛ to 3 inches.

It is another object of the lighting system for the lights to function as flashers, blinkers, wave effect, dim to bright and random (switch between blinking, wave, dim to bright) color patterns such as but not limited to all reds blink, then all greens, then yellows, then all colors blink together. Symbols or design lighting holiday messages such as but not limited to happy new year, happy birthday, merry Christmas, happy holidays, happy Hanukah and happy kwanza, with a variety or combination of Santa Claus, Rudolph Red Nose Reindeer, Santa's Sleigh, Christmas tree, etc . . .

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

FIG. 2A-2D show various styles of lighting that can be used with the remote controlled hideaway holiday party lighting apparatus.

FIG. 3 shows a view of a display screen matrix of lights that can extend from the remote controlled hideaway holiday party lighting apparatus.

DETAILED DESCRIPTION OF THE INVENTION

Figure 1:
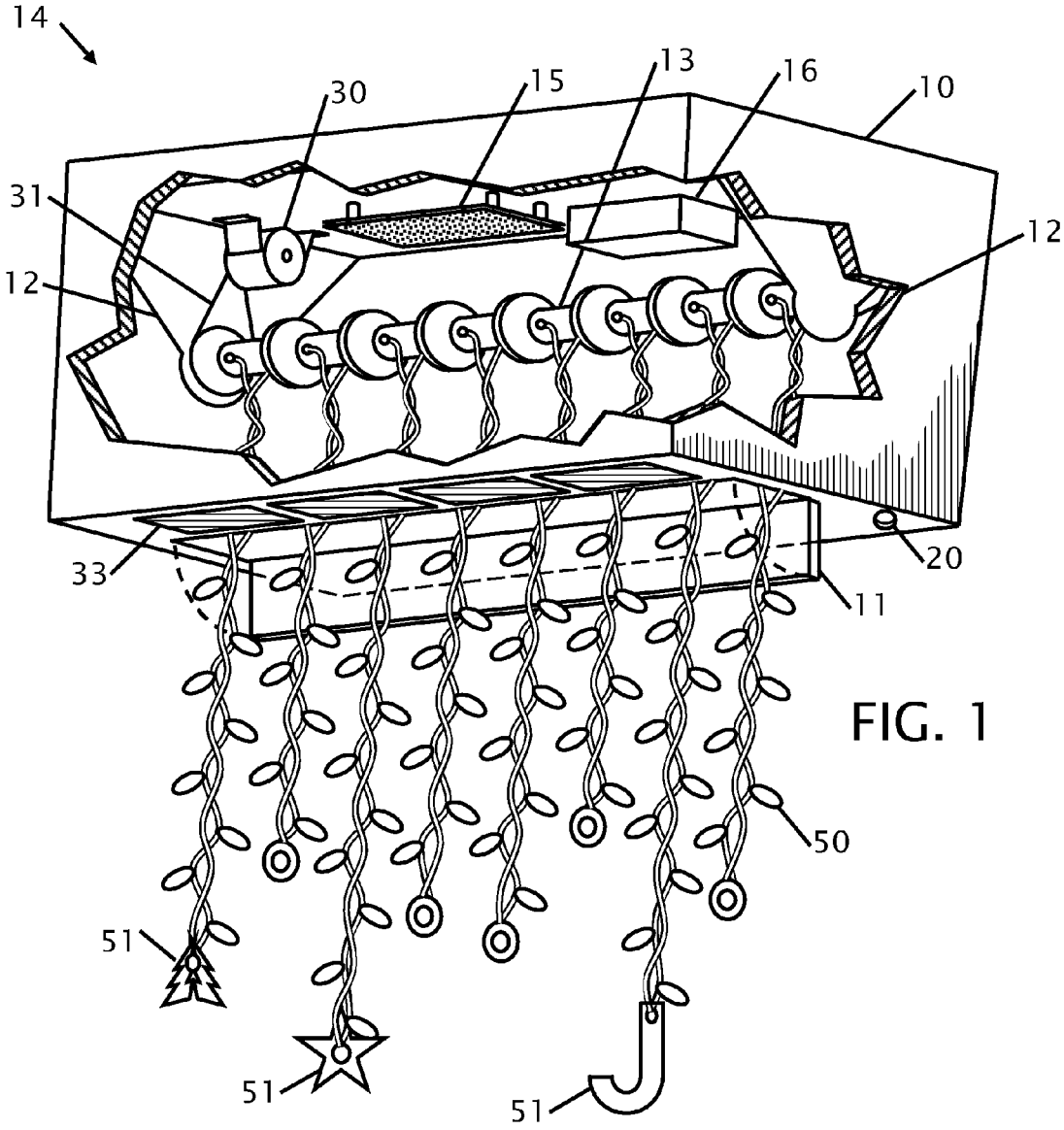
FIG. 1 shows an isometric cut-away view of the remote controlled hideaway holiday party lighting apparatus.
Figure 8:
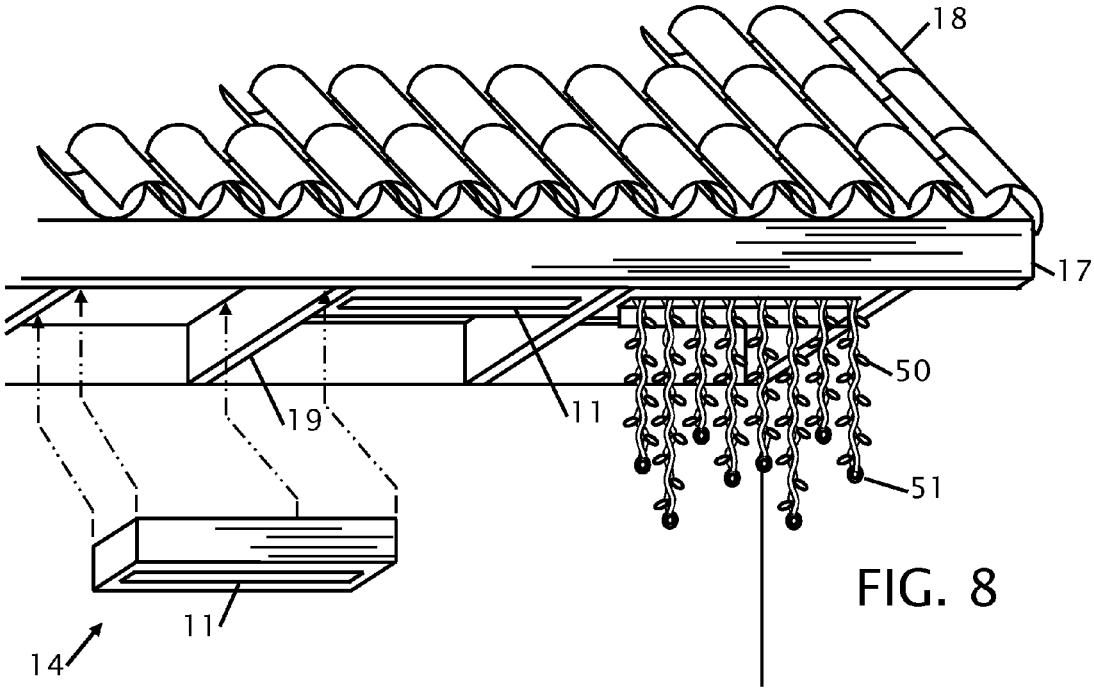
FIG. 8 shows the remote controlled hideaway holiday party lighting apparatus in use and being installed on a house or business.

FIG. 1 shows an isometric cut-away view of the remote controlled hideaway holiday party lighting apparatus 14. The apparatus is in an enclosure 10 that is manufacturability in various widths to accommodate the eves and rafters of a house. FIG. 8 shows the remote controlled hideaway holiday party lighting apparatus in use and being installed on a house or business. In FIG. 8, the apparatus 14 is shown being placed and installed under or behind the fascia or eve 17 and between the studs 19 under the roof shingles 18. From FIG. 8 the apparatus 14 is shown with the lights extended with the bulbs 50 and the weight 51 suspended from the enclosure 10 on the right most enclosure 10. The weight 51 helps to keep the wires straight and reduces tangles. The weight can be made in a variety of shapes ranging from a blob or washer to seasonal or festive shapes like stars, trees, candy canes or other shapes. In the middle of the figure, the apparatus 14 is shown installed with just the bottom and the door 11 visible. In the left, apparatus 14 is shown being installed between the studs 19. The apparatus is installable underneath over hangs, fascia, joists, borders or rain gutters. The lights roll up and down thereby allowing the stringed light to hang below the enclosure 10 from between 6 to 12 inches during the holiday season or party event.

Figure 6:
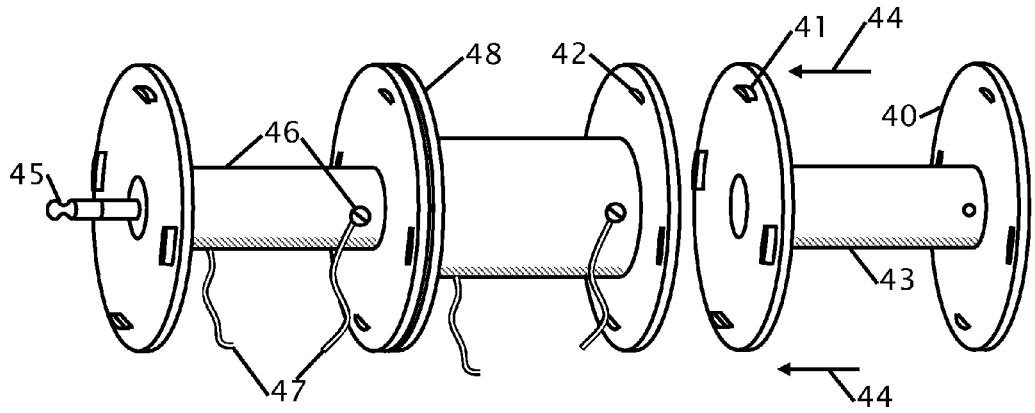
FIG. 6 shows a preferred embodiment of the spools for the remote controlled hideaway holiday party lighting apparatus.

Referring back to FIG. 1 that shows just the apparatus 14. At least one set of stringed lights 50 are wound on a rod 13. The rod 13 allows the lights to be retracted of extended as they are wound onto or off of the rod 13. FIG. 6 shows a preferred embodiment of the spools or rods 40 for the remote controlled hideaway holiday party lighting apparatus. Each spool 40 has sides or separators 48 that keep the strands of lighting rolled onto separate tubes 43 thereby helping them from getting tangled. The tube is constructed with different diameters depending upon the hang length to create desired varying hang length(s).

Each set of stringed lights are attached, affixed, connected, or corrugated to the tube using grooves or guides to allow smooth seating of each stringed light with a separator between each strand of stringed lights to prevent tangling of the at least one set of stringed lights thereby allowing ease an access to change or repair lighting string or tubing.

A connector 45, that is similar to a phone jack, connects the spool to the strings of lights. The connector allows the spool (s) 40 to spin and still remain connected to the electricity. Each spool 40 has a series of snaps 41 and holes 42 that allow multiple spools 40 to connect together 44 to make the sub assembly fit between different widths of joists as shown in FIG. 8. The expandable pieces are user configurable to accommodate house or building construction geometry. The strands of lighting wires 47 are electrically connected 46 to the spool(s) 40. The set of stringed lights is pinned or bolted to the tube 43.

Figure 7:
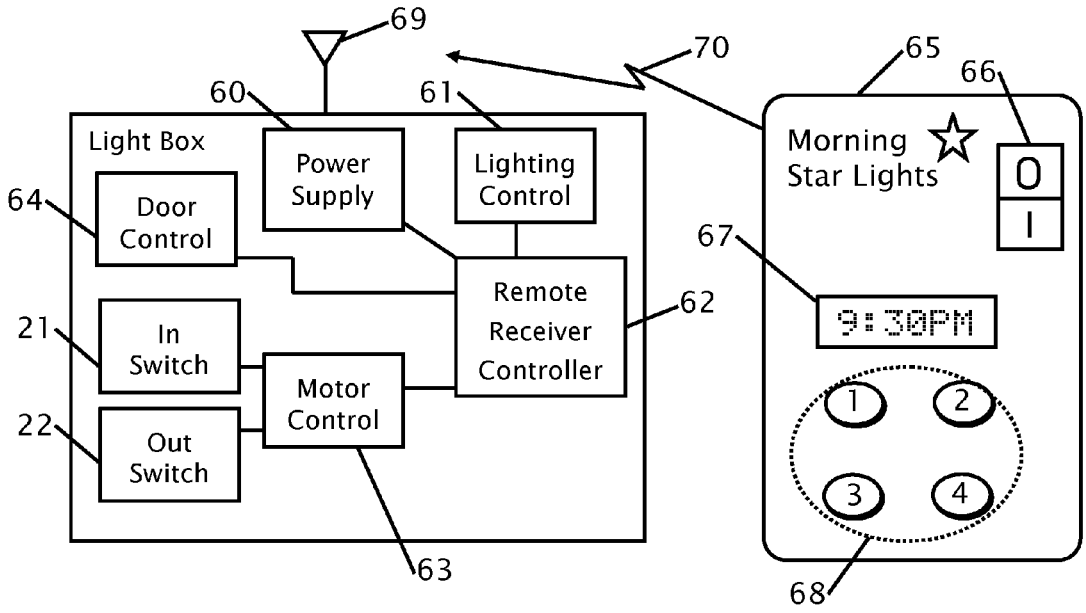
FIG. 7 shows the remote control and a block diagram of the receiver for the remote controlled hideaway holiday party lighting apparatus.

Referring back to FIG. 1, the rod 13 is suspended on end supports 12. A belt 31 connects the rod 13 to a motor 30. The motor 30 is controlled by a circuit board 15 and can be powered by external power or batteries 16. Power can also be generated from solar cells 33. A door 11 opens 11 to allow the lights to extend and be concealed within the enclosure 10. A light sensor 20 can be used to notify the apparatus that it is dark or light outside whereby allowing the apparatus 14 to open and close autonomously when it is dark. The sensor 20 can suspend operation when weather makes operation unsafe to itself or people. FIG. 7 shows the remote control and a block diagram of the receiver for the remote controlled hideaway holiday party lighting apparatus.

Figure 4:
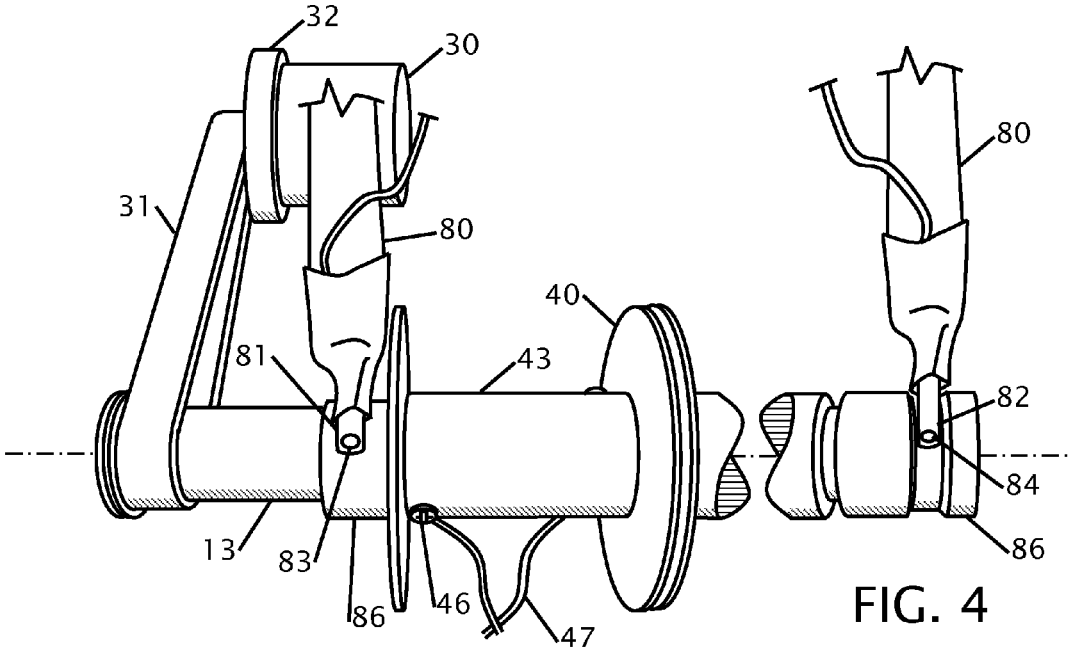
FIG. 4 shows a perspective view of the winding rod with the motor and electrical contacts.
Figure 5:
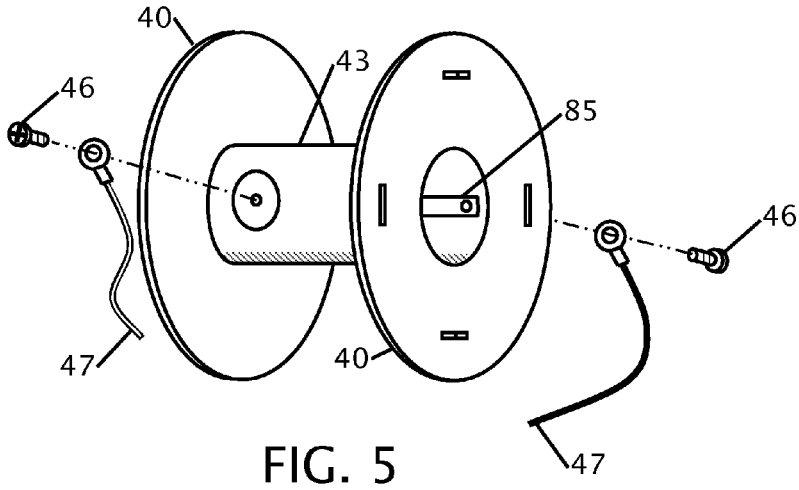
FIG. 5 shows a perspective view of a spool with the internal conductor strip.

FIG. 4 shows a perspective view of the winding rod with the motor and electrical contacts and FIG. 5 shows a detailed perspective view of a spool with the internal conductor strip. The motor 30 is optionally connected to a gear drive 32 that reduces the RPM of the motor 30. A drive belt 31 connects the output shaft of the motor 30 or gear drive 32 to the rod 13. In one contemplated embodiment the belt and pulleys have teeth to ensure accurate and consistent displacement of the light. Electrical power for the light is provided by contact arms 80 that have positive 82 and negative 81 wipers that make electrical connection with positive 84 and negative 83 contacts on conductor ferrules 86 that conduct along the length of the rod 13.

FIG. 5 shows a spool 40 with contact 85 that makes electrical contact to a positive or negative ferrule while a complimentary contact (not shown) makes electrical contact with the opposing electrical ferrule. Each spool has a central tube section 43 for guiding and retaining the electrical wiring to the lights. Each spool 40 has a positive and a negative contact that is electrically connected to the complimentary positive or negative ferrule, contact and wiper. The wiring to each string of lights is connected with wires 47 that are screwed 46 into the tube section 43 of each spool 40.

In FIG. 7 the remote on the right 65 is intended for use by the homeowner or business owner to operate, control and program the apparatus 14. The remote control has a unique communications address with a distinctive key code comparable to a garage door setting which makes each owner display unique. The unique code allows the remote control holiday light display to be unaltered to the settings of a neighbor. One remote can operate all or a limited number of remote controlled hideaway holiday party lighting devices In a preferred embodiment the remote control transmitter 65 has a power on and off switch 66. A series of control buttons 68 to select and set the pattern or information that is shown on the lights. A display 67 lets the user set the time for the lights to be extended and retracted. FIG. 3 shows a view of a display screen matrix panel 52 of lights that can extend from the remote controlled hideaway holiday party lighting apparatus. The display screen panel 52 rolls from the rod 13. The remote 65 allows the user to select the display message and or pattern. The stringed lights are formed in a matrix to create scenes, images or phrases of the holiday season said scenes, images or phrases of the holiday season. At least one set of stringed lights have light sequencing selected from the group consisting of on, flashing, blinkers, wave effect, dim to bright, color flashing, patterns and symbols or design lighting holiday messages.

Symbols or design lighting holiday messages such as but not limited to happy new year, happy birthday, merry Christmas, happy holidays, happy Hanukah and happy Kwanzaa, with a variety or combination of Santa Claus, Rudolph Red Nose Reindeer, Santa's Sleigh, Christmas tree, etc. The remote 65 transmits a signal 70 to the receiver's antenna 69. The receiver is a part of the circuit board 15 found in FIG. 1. The receiver has a remote receiver controller 62 that controls the door operation 64, motor 63, lighting 61 and the in/out sensors 21, 22. A power supply 60 provides operation power to the apparatus. The power supply can be from external power and or batteries that are charged by external power or solar cells 33 shown in FIG. 1. The power supply operates either by AC power or DC battery power to decode instructions from the remote control, operate said door, turn the tube and operate the set of stringed lights 50.

The controller 62 has control over an operable door 11 that opens to allow said at least one set of stringed lights to hang through the operable door 11 and further to close the operable door 11 when the at least one set of stringed lights are sufficiently wound on the tube, rod 13 or spindle.

FIGS. 2A-2D show various styles of lighting that can be used with the remote controlled hideaway holiday party lighting apparatus. At least one set of stringed lights has light colors selected from the group consisting of yellow, white, green, blue, red, and orange. At least one set of stringed lights have light styles selected from the group consisting of string drape, mini lights, florescent, light emitting diodes, flashing, blinking, fiber-optic, incandescent and pearls. The at least one set of stringed lights have light sizes of between ⅛ inch in diameter to 3 inches in diameter.

Figure 9:
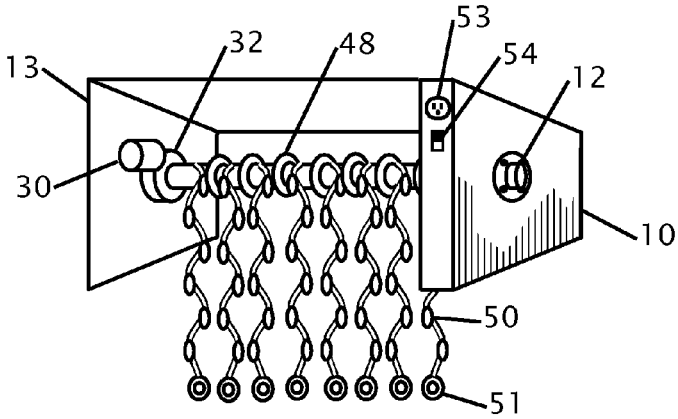
FIG. 9 shows a partial assembly view of the remote controlled hideaway holiday party lighting apparatus showing some of the internal mechanical components.

FIG. 9 shows a partial assembly view of the remote controlled hideaway holiday party lighting apparatus showing some of the internal mechanical components. The enclosure 10 shows the end support 12 with strings of lights connected to the rod 13 connected to a motor 30 and a gear train 32 if required. An outlet 53 and a switch 54 may optionally be placed on the enclosure 10.

It is further contemplated that the remote controlled celebratory lighting/message system can be permanently affixed to a building or structure that gives the consumer choices to celebrate all their favorite holidays and special occasion i.e. New Years, Valentine's Day, St. Patrick's Day, Cinco De Mayo, Juneteenth, $4^{th}$ of July, Halloween, Thanksgiving, Christmas, Hanukkah, Kwanzaa, Cherry Blossom festival, happy anniversary, Weddings, Back Yard parties, etc. Now you can celebrate all your holidays and occasions in one celebratory illumination system at the push of a button, illuminating system is adjustable or expandable to fit between rafter or under the eaves (directly in the interior of the eaves) inside the new building or structure as well as allowing the lights to pulse or blink (dance) to the to the beat of the music, celebratory lights also ties into the home or business alarm system where the alarm systems activates the lights to roll up and down, repeatedly, celebratory lights have a motion sensor as people or cars or entities pass by the celebratory lights they appear to brighten or blink in the direction of movement, celebratory lighting system has various styles, patterns, colors of lights to represent all U.S. and International holidays and special events i.e. Valentines Day lights would be red, pink and white each holiday has it's own specific color representation. Now this removes the constant hassle of climbing up and down ladders yearly to hang, remove and store celebratory lighting and messages.

It is further contemplated that the remote controlled celebratory lighting/message system uses connections that are seamless when installed (looks like one piece) rain gutters. where the lighting system can be controlled by a remote control. The ideal systems would be expandable to fit residential and commercial structures different dimension and sizes and is customizable to fit under the eaves or between the rafters.

It is further contemplated that the remote controlled celebratory lighting/message system that interface with the house alarm system of the structure through a wired or the wireless remote. The remote controlled celebratory lighting/message system can be installed or built on a gazebo built or on the exterior of the overhang of a structure.

Thus, specific embodiments of a remote controlled hide-away holiday party lighting apparatus have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A remote control string lighting apparatus comprising:

an enclosure;

a plurality of strands of stringed lights that are wound on a tube;

a motor connected to said tube for rotating said tube;

a remote control transmitter; and a remote control receiver, said receiver comprising a motor controller and a lighting controller to operate said motor and said stringed lights respectively;

wherein said enclosure further comprises an operable door that opens to allow said stringed lights to hang through an opening formed in said enclosure, and said door closes when said stringed lights are sufficiently wound on said tube.

2. The apparatus according to claim 1 wherein said remote control receiver controls moveable parts that are controlled by said remote control transmitter, a solar sensor or a timer, to control the opening and closing of the door.

3. The apparatus according to claim 1 wherein said stringed lights have light colors selected from the group consisting of yellow, white, green, blue, red, and orange.

4. The apparatus according to claim 1 wherein said stringed lights have light styles selected from the group consisting of string drape, mini lights, florescent, light emitting diodes, flashing, blinking, fiber-optic, incandescent and pearls.

5. The apparatus according to claim 1 wherein said stringed lights have light sizes of between ⅛ inch in diameter and 3 inches in diameter.

6. The apparatus according to claim 1 wherein said stringed lights have light sequencing selected from the group consisting of on, flashing, blinkers, wave effect, dim to bright, color flashing, patterns and symbols or design lighting holiday messages.

7. The apparatus according to claim 1 wherein said apparatus is installable underneath over hangs, fascia, joists, borders or rain gutters.

8. The apparatus according to claim 1 wherein said apparatus rolls said plurality of strands of lights up and down thereby allowing said at least one set of stringed light to hang below said enclosure from between 6 to 12 inches during the holiday season or party event.

9. The apparatus according to claim 8 wherein said tube is constructed with a plurality of portions of different diameters to create varying hang lengths for the plurality of strands of stringed lights.

10. The apparatus according to claim 1 wherein said plurality of strands of stringed lights are attached, affixed, connected, or corrugated to said tube using grooves or guides to allow smooth seating of each stringed light strand with a separator between each strand of stringed lights to prevent tangling of said of stringed lights, thereby allowing easy access to change or repair the lighting string or tubing.

11. The apparatus according to claim 1 wherein each strand of stringed lights is pinned or bolted to said tube.

12. The apparatus according to claim 1 that further includes a power supply for illumination and powering moving parts controlled by said remote control.

13. The apparatus according to claim 12 wherein said power supply operates either by AC power or DC battery power to decode instructions from said remote control, operate said door, turn said tube and operate said stringed lights.

14. The apparatus according to claim 1 that further includes a sensor to suspend operation when weather makes operation unsafe.

15. The apparatus according to claim 1 wherein said tube is constructed in expandable pieces that are user configurable to accommodate house or building construction geometry.

16. The apparatus according to claim 1 wherein said enclosure is configured to mount between roof studs behind a soffit or fascia.

17. The apparatus according to claim 1 further including more than one tube and set of stringed lights strands to provide multiple layers of lighting.

18. The apparatus according to claim 1 wherein said remote control transmitter allows operation of said door, said motor and said stringed lights independently.

19. The apparatus according to claim 1 wherein said stringed lights are formed in a matrix to create scenes, images or phrases of the holiday season.

20. The apparatus according to claim 19 wherein said remote control allows for selection or entry of said scenes, images or phrases of the holiday season.

* * * * *